US009234354B2

(12) United States Patent
Gardner

(10) Patent No.: US 9,234,354 B2
(45) **Date of Patent: *Jan. 12, 2016**

(54) STAIR NOSING ASSEMBLY

(71) Applicant: William Gardner, Salem, OR (US)

(72) Inventor: William Gardner, Salem, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/468,806

(22) Filed: Aug. 26, 2014

(65) Prior Publication Data

US 2014/0360112 A1 Dec. 11, 2014

Related U.S. Application Data

(63) Continuation of application No. 13/368,699, filed on Feb. 8, 2012, now Pat. No. 8,850,757.

(60) Provisional application No. 61/441,504, filed on Feb. 10, 2011.

(51) Int. Cl.

| | |
|---|---|
| ***E04F 11/16*** | (2006.01) |
| ***E04F 11/116*** | (2006.01) |
| ***E04F 11/104*** | (2006.01) |

(52) U.S. Cl.

CPC ..... *E04F 11/163* (2013.01); *E04F 11/104* (2013.01); *E04F 11/116* (2013.01); *E04F 11/166* (2013.01)

(58) Field of Classification Search

CPC ..... E04F 11/104; E04F 11/116; E04F 11/16; E04F 11/163; E04F 11/165; E04F 11/17; E04F 11/175; E04G 21/30

USPC ..... 52/98–100, 179, 181, 182, 189, 295; 249/13, 14, 52, 214

See application file for complete search history.

(56) References Cited

U.S. PATENT DOCUMENTS

| | | | |
|---|---|---|---|
| 1,566,042 | A | 12/1925 | Schmidt |
| 1,667,040 | A | 4/1928 | Larkin |
| 1,681,073 | A | 8/1928 | Welcome |
| 1,966,402 | A | 7/1934 | Barringer |

(Continued)

FOREIGN PATENT DOCUMENTS

| | | | |
|---|---|---|---|
| EP | 1302606 | A1 | 4/2003 |
| WO | WO 2008/048114 | A2 | 4/2008 |

OTHER PUBLICATIONS

Office Action from the United States Patent & Trademark Office in U.S. Appl. No. 11/820,274, dated Oct. 1, 2008, 11 pages.

(Continued)

*Primary Examiner* — Basil Katcheves
*Assistant Examiner* — Theodore Adamos
(74) *Attorney, Agent, or Firm* — Klarquist Sparkman, LLP

(57) ABSTRACT

An exemplary stair nosing assembly comprises an elongated base, a plate adhered to the base, and a cover temporarily covering the base and the plate. The base has at least one anchor portion extending downwardly from the upper portion for attaching to a lip of a tread pan and/or embedding in a concrete tread. The plate can have various features to enhance traction and visibility. The cover has front and rear lips that engage with front and rear edges of the base, and a weakened region adjacent the rear lip. When the assembly is embedded in a concrete tread, the cover is configured to fracture at the weakened region when the front lip of the cover is lifted upward from the base, leaving the rear lip remaining embedded in the concrete and allowing the rest of the cover to be removed to expose upper surfaces of the base and plate.

14 Claims, 3 Drawing Sheets

(56) References Cited

U.S. PATENT DOCUMENTS

| | | | |
|---|---|---|---|
| 2,072,758 | A | 3/1937 | Schmeller, Sr. |
| 2,265,735 | A | 12/1941 | Lambert |
| 2,278,554 | A | 4/1942 | Morton |
| 2,835,937 | A | 5/1958 | Hobbs |
| 2,999,280 | A | 9/1961 | Miller |
| 3,334,456 | A | 8/1967 | Naka |
| 3,421,274 | A | 1/1969 | Balzer et al. |
| 3,557,504 | A | 1/1971 | Graf |
| 3,759,000 | A | 9/1973 | Balzer et al. |
| 4,001,991 | A | 1/1977 | Balzer et al. |
| 4,037,374 | A | 7/1977 | Balzer et al. |
| 4,058,942 | A | 11/1977 | Naka |
| 4,112,641 | A | 9/1978 | Balzer |
| 4,151,320 | A | 4/1979 | Naka |
| 4,321,293 | A | 3/1982 | Naka |
| 4,321,294 | A | 3/1982 | Naka |
| 4,322,927 | A | 4/1982 | Scott |
| 4,455,797 | A | 6/1984 | Naka |
| 4,486,987 | A | 12/1984 | Naka |
| 4,840,824 | A | 6/1989 | Davis |
| 4,879,151 | A | 11/1989 | Ellingson, Jr. |
| 4,893,442 | A | 1/1990 | Graham et al. |
| 4,905,431 | A | 3/1990 | Davis |
| 4,985,095 | A | 1/1991 | Riddle |
| 5,073,430 | A | 12/1991 | Aidan |
| 5,103,608 | A | 4/1992 | Andreo |
| 5,357,724 | A | 10/1994 | Sonoda |
| D363,785 | S | 10/1995 | Davies |
| 5,461,836 | A | 10/1995 | Yang |
| 5,623,804 | A | 4/1997 | Kelly et al. |
| 5,840,396 | A | 11/1998 | Betz |
| 5,904,017 | A | 5/1999 | Glatz et al. |
| D415,289 | S | 10/1999 | Dalton |
| 6,082,061 | A | 7/2000 | Ryan |
| 6,101,770 | A | 8/2000 | Dalton |
| 6,141,920 | A | 11/2000 | Kemper |
| 6,173,540 | B1 | 1/2001 | Spivey |
| 6,260,313 | B1 | 7/2001 | Stegmeier |
| D447,249 | S | 8/2001 | Chang et al. |
| D463,039 | S | 9/2002 | Tseng |
| 6,554,446 | B1 | 4/2003 | Walsh et al. |
| 6,606,827 | B1 | 8/2003 | Hoffmann |
| D505,211 | S | 5/2005 | Stanchfield |
| D563,565 | S | 3/2008 | Gardner |
| 7,401,560 | B2 | 7/2008 | McCrary |
| 8,850,757 | B2 * | 10/2014 | Gardner ..... 52/179 |
| 2002/0066242 | A1 | 6/2002 | Hsu |
| 2002/0110682 | A1 | 8/2002 | Brogan |
| 2005/0039409 | A1 | 2/2005 | Sondermann |
| 2006/0150539 | A1 | 7/2006 | Vanhastel et al. |
| 2010/0251627 | A1 | 10/2010 | Kay |

OTHER PUBLICATIONS

Office Action from the United States Patent & Trademark Office in U.S. Appl. No. 11/820,274, dated May 27, 2009, 14 pages.

Office Action from the United States Patent & Trademark Office in U.S. Appl. No. 11/820,274, dated Dec. 24, 2009, 15 pages.

Office Action from the United States Patent & Trademark Office in U.S. Appl. No. 11/820,274, dated May 10, 2010, 16 pages.

Office Action from the United States Patent & Trademark Office in U.S. Appl. No. 13/368,699, dated Oct. 10, 2013, 20 pages.

Office Action from the United States Patent & Trademark Office in U.S. Appl. No. 13/368,699, dated Mar. 13, 2014, 18 pages.

Pages of McNichols Co. website, "Expanded Grating Stair Treads—Standard Unitread®," http://mcnichols.com/products/stairtreads/expanded/, 2006, 2 pages.

Pages of Loxcreen Company, Inc. website, "Bengard Floor Moulding—Aluminum Stair Nosing," http://www.loxcreen.com/floor/bengardfloor/floor_stairnosing.htm, 2003, 3 pages.

Statement by William Gardner regarding prior staircase nosing prototypes manufactured, dated Apr. 23, 2010, 4 pages.

Wooster Products, Inc. specification sheet for Abrasive Cast Safety Treads and Nosings—Type 100, Jan. 2005, 1 page.

Wooster Products, Inc. specification sheet for Abrasive Cast Safety Treads and Nosings—Type 101, Jan. 2005, 1 page.

Wooster Products, Inc. specification sheet for Spectra® Safety Treads—Type WP24, Oct. 2003, 1 page.

Wooster Products, Inc. specification sheet for Spectra® Safety Treads—Type WP3C, Feb. 2003, 1 page.

* cited by examiner

STAIR NOSING ASSEMBLY

CROSS REFERENCE TO RELATED APPLICATION

This application is a continuation of U.S. patent application Ser. No. 13/368,699, filed Feb. 8, 2012, which claims the benefit of U.S. Provisional Patent Application Ser. No. 61/441,504, filed Feb. 10, 2011, both of which are herein incorporated by reference in their entirety.

BACKGROUND

A staircase is typically one of the first parts of a building to be constructed. After the stairs are constructed, they are often used by construction workers while the remainder of the building is constructed and finished. This period of time after the stairs are constructed and before the building is finished can expose stairs, and particularly front nosings of the stairs, to significant damage, wear, contamination, etc. For example, the exposed features of the stair nosings can be scratched, dented or splashed with paint or other material while the building is being finished.

To protect the stair nosings after they are constructed, construction works often place a layer of tape over the upper surfaces of the nosings and then remove the tape after construction of the building is complete.

SUMMARY

Embodiments of stair nosing assemblies are disclosed herein that come pre-assembled with a protective cover layer that can remain covering the nosing after construction of the stairs while the remainder of the building is constructed and finished. The cover can then be quickly, easily, and accurately removed by lifting a front lip and thereby breaking the front and upper portions of the cover apart from an embedded rear lip.

One exemplary stair nosing assembly can comprise an elongated polymeric base, an elongated metal plate adhered to the base, and an elongated polymeric cover temporarily covering the base and the plate. The base can comprise at least one anchor portion extending downwardly from the upper portion for attaching the assembly to a rearward projecting lip of a tread pan and/or for embedding in a concrete tread. The plate can have various features to enhance traction and visibility. The cover can comprise front and rear lips that engage with front and rear edges of the base to temporarily secure the cover over upper surfaces of the base and the plate. The cover can further comprise a horizontally extending weakened region adjacent to or in the rear lip. When lower portions of the assembly are embedded in a concrete tread, the cover is configured to fracture along the weakened region when the front lip of the cover is lifted upward from the base, leaving the rear lip of the cover remaining embedded in the concrete and allowing the rest of the cover to be removed to expose upper surfaces of the base and plate.

The foregoing and other objects, features, and advantages of the disclosure will become more apparent from the following detailed description, which proceeds with reference to the accompanying figures.

DETAILED DESCRIPTION

Described herein are embodiments of a nosing assembly, components thereof, and methods related thereto. The following description is exemplary in nature and is not intended to limit the scope, applicability, or configuration of the invention in any way. Various changes to the described embodiment may be made in the function and arrangement of the elements described herein without departing from the scope of the invention.

The nosing assembly and components described herein are primarily intended for use with stair construction, but can also be used to form a nosing for other similar structures or objects, such as curbs, sidewalks, ledges, edges, and the like. Thus, although this disclosure proceeds with reference mainly to stairs, one of ordinary skill will understand that the inventive features disclosed herein can similarly be applied to these analogous fields of endeavor.

Figure 1:
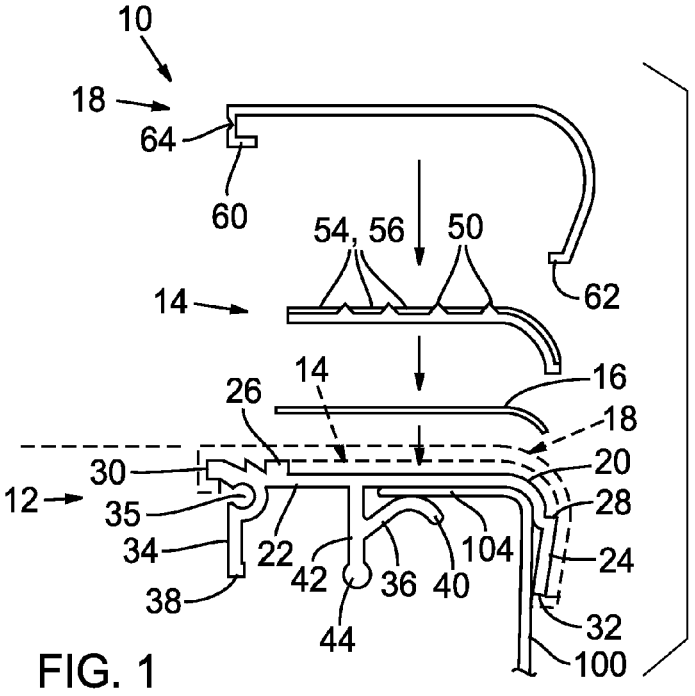
FIG. 1 is an exploded cross-sectional end view of an exemplary stair nosing assembly, shown in the context of other portions of a stair.
Figure 2:
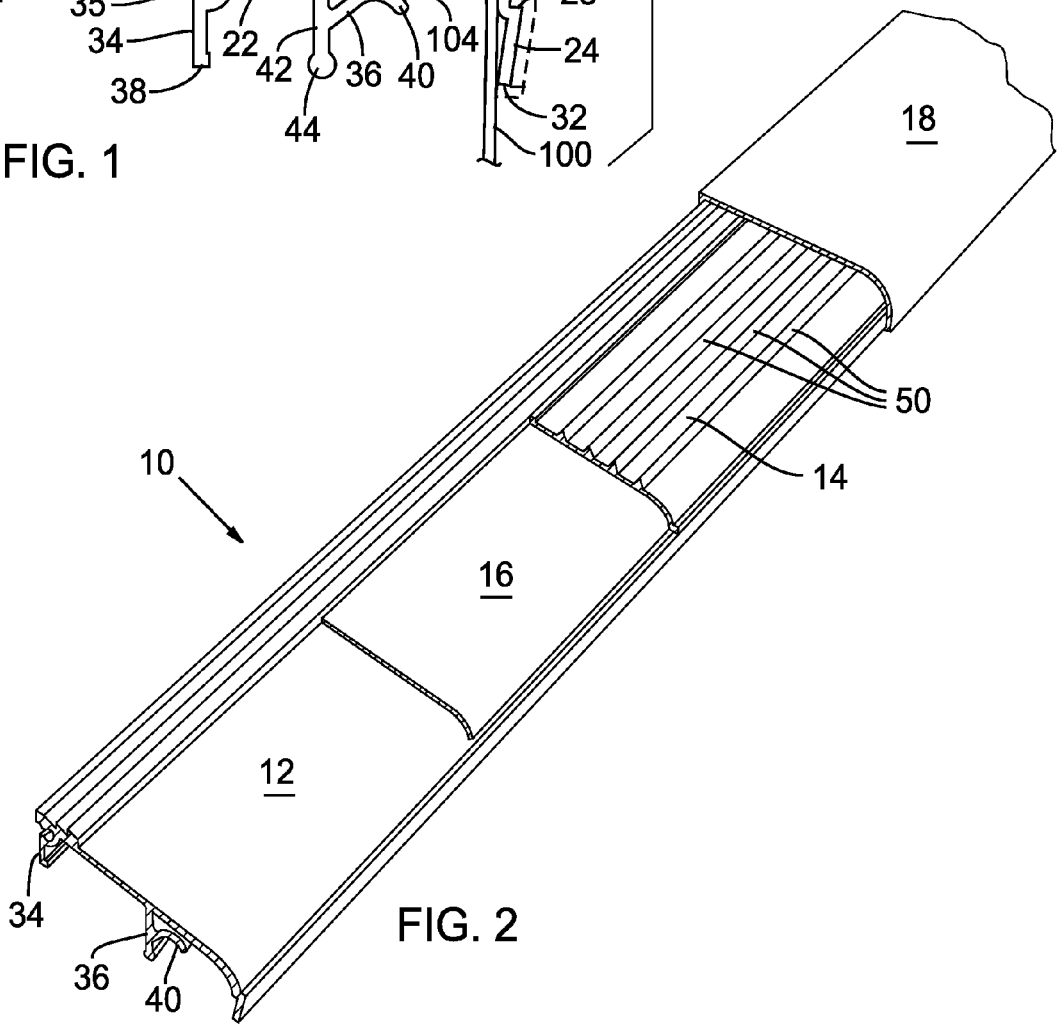
FIG. 2 is a perspective view of the assembly of FIG. 1, with various components of the assembly cut away at different lengths for illustrative purposes.

As shown in FIGS. 1 and 2, a nosing assembly 10 can comprise a plurality of components. These components can include a base 12, a plate 14, an adhesive 16, a cover 18, and/or other optional components. The nosing assembly can be pre-assembled and installed as a unit during the construction of a stair or a stair case. The base 12 can couple the nosing assembly 10 to a stair. The adhesive 16 can couple the plate 14 to the base 12. The cover 18 can cover and protect the base 12 and plate 14 from damage and/or contamination, such as during transportation and construction, and can be removed to expose the base 12 and plate 14 (see FIG. 4), such as after construction of the stair case is complete.

The nosing assembly 10 can be elongated and have a generally constant cross-section transverse to the elongated direction, or length. The length of the nosing assembly 10 can be selected to correspond to the width of the stair on which it is installed. The base 12, plate 14, adhesive 16 and cover 18 can each have the same or similar length. The nosing assembly 10 can be any width (measured from the front edge to the rear edge), and in some embodiments is approximately two inches wide.

The base, or tread portion, 12 can be comprised of a durable polymeric material, such as PVC. As shown in FIG. 1, the base 12 can comprise a tread portion 20 that forms a generally horizontal upper portion 22 and curves downwardly at a front side to form a generally vertical front lip 24. The tread portion 20 can further comprise a recessed area between a front rib 28 and a rear rib 26. This recessed area can be sized and shaped to receive the adhesive 16 and the plate 14 between the ribs 26 and 28.

The rear of the upper portion 22 can terminate in a rear edge 30 and the bottom of the front lip 24 can terminate in a bottom edge 32. The rear edge 30 and bottom edge 32 can engage with the cover 18, as described below.

The base 12 can comprise a downwardly projecting rear flange 34 extending from the rear of the upper portion 22. The rear flange 34 can comprise a rearwardly opening recess, or cavity, 35 adjacent the upper portion 22 and an expanded bottom end portion 38. The cavity 35 can extend horizontally along the base and can be configured to receive another component in a snap-fit connection. The cavity 35 can alternatively be filled with concrete during installation and help retain the nosing 10 to the step.

Figure 4:
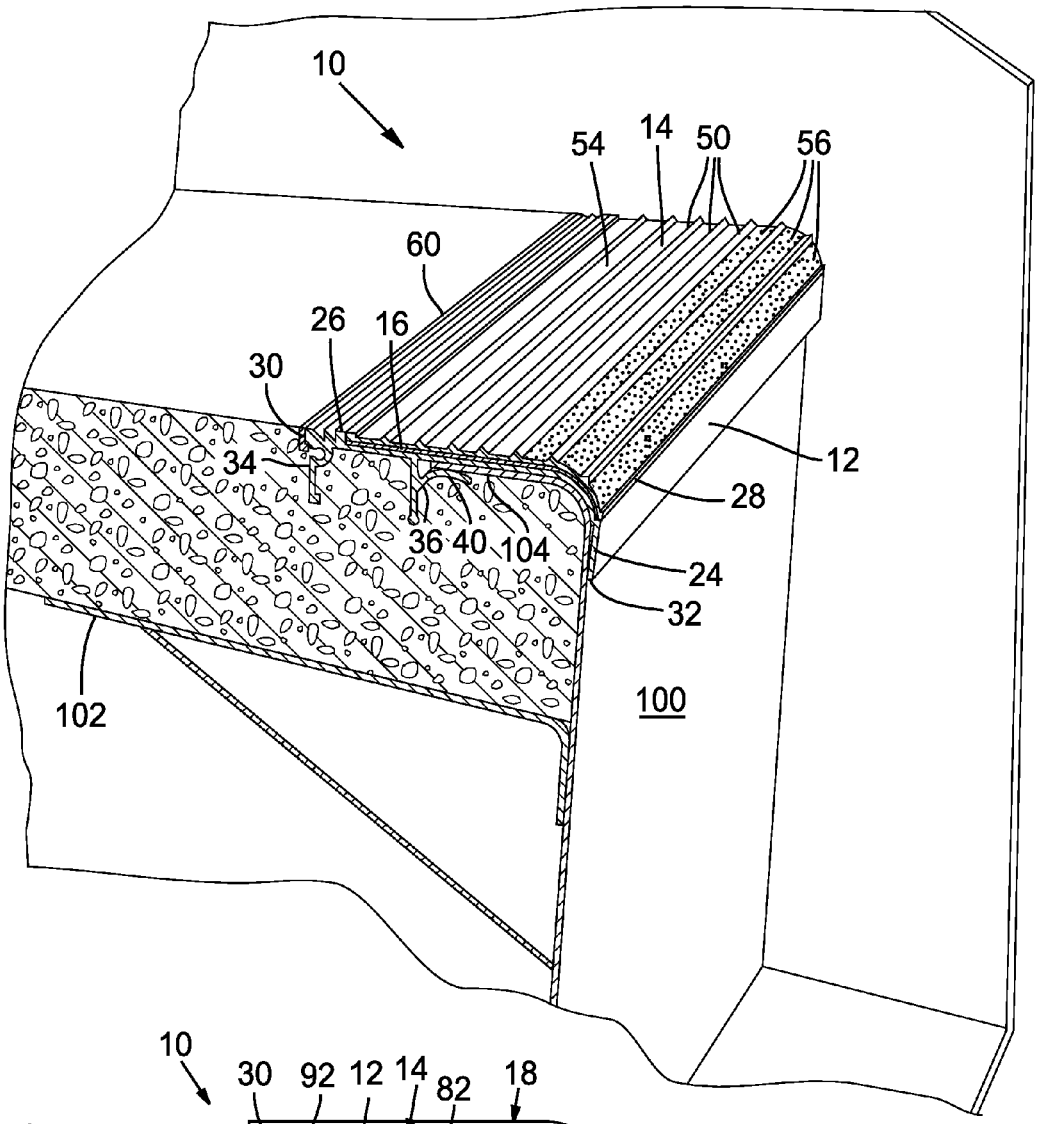
FIG. 4 is a cross-sectional perspective view of a finished concrete and metal stair with the stair nosing assembly of FIGS. 1 and 2 installed, after a cover layer has been removed.
Figure 5:
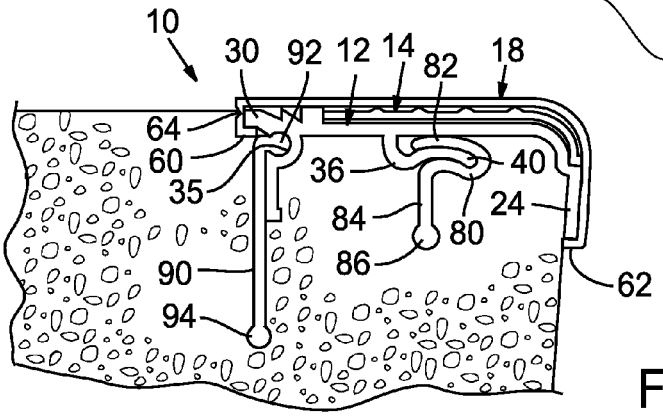
FIG. 5 is a cross-sectional end view of a finished concrete stair with an alternative embodiment of the nosing assembly installed, prior to the cover layer being removed.

The base 12 can further comprise a downwardly projecting anchor portion 36 extending from the lower surface of the upper portion 22 between the rear flange 34 and the front lip 24. The anchor portion 36 of the base 12 can comprise a forwardly extending lip 40 and/or a downwardly extending flange 42 that terminates in an expanded bottom end portion 44. The lip 40 can be used to couple the base 12 to a rearwardly projecting lip of a tread pan, as shown in FIG. 4, or to an anchor 80 mounted in the concrete, as shown in FIG. 5.

The plate 14 can be comprised of durable material, such as a suitable metal (e.g., aluminum or steel) and/or polymeric material. The plate 14 can comprise a variety of upper surface features designed to provide foot traction, illumination, aesthetic appearance, and/or other functions. For example, the plate 14 can comprise one or more ribs 50 extending lengthwise of the plate, as shown in FIGS. 1-4. The plate 14 can further comprise a friction-enhancing material and/or a textured pattern 52 on the upper surface, such as knurling, to provide grip and/or an aesthetic appearance. One or more surfaces of the plate 14 can further comprise a photoluminescent, or "glow-in-the-dark," material, such as the photoluminescent strips 54 shown in FIGS. 1 and 4. One or more surfaces of the plate 14 can also comprise a friction-enhancing material, such as the strips 56 shown in FIGS. 1 and 4. The photoluminescent material and/or the friction-enhancing material can comprise strips of material inserted into mating receptacles in the plate 14 between the ribs 50. These materials can comprise a spray-on substance, adhesive strips, or other materials coupled to the plate. In addition, various surfaces of the plate 14 can be coated or painted to provide desirable properties, such as aesthetic appearance.

On some exemplary embodiments, the upper and/or lower surfaces of the plate 14 are painted, such as black or yellow. Yellow paint, for example, can provide a visual alert and/or contrast with other materials to signify the edge of a step. In one example, an aluminum plate is first painted black, and then portions of the black paint are removed, such as the top edges of the ribs 50 and/or the front and rear edges of the plate, to expose the shiny, silvery color of the metal, creating a contrasting silver and black contrast. In this example, the black can be replaced with any other color, such as yellow, to provide a similar effect.

The plate 14 can be coupled to the base 12 using an adhesive 16, such as a double-sided tape, a layer of adhesive applied in fluid form, or the like. The adhesive 16 can be releasable in order to allow removal and replacement of the plate 14, such as if the plate is worn or damaged or if a plate with different surface features is desired. To remove and replace the plate 14, the plate can simply be peeled off, the adhesive 16 can be removed, and a plate can be attached with a new adhesive.

Figure 3:
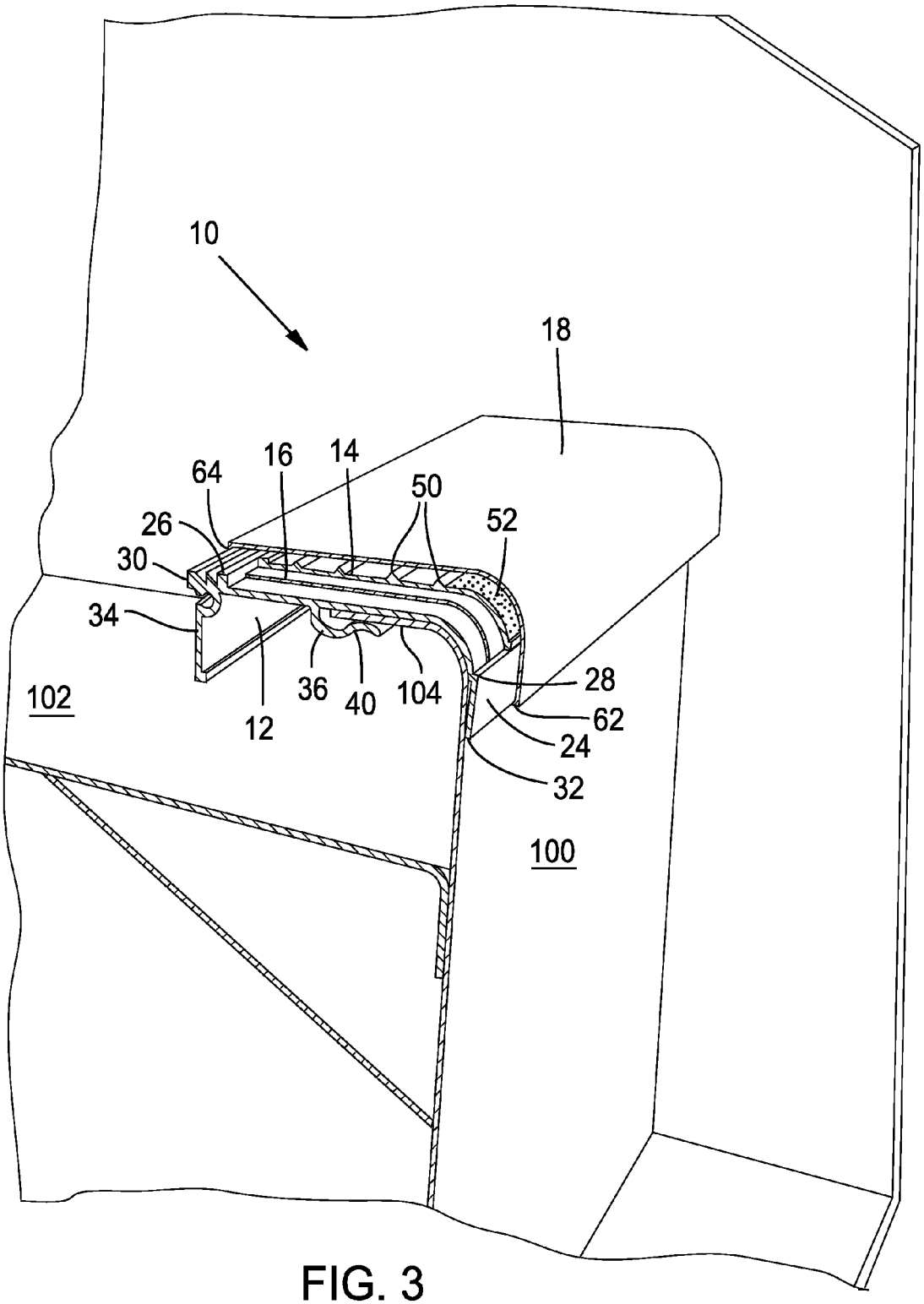
FIG. 3 is a cross-sectional perspective view of another exemplary stair nosing assembly shown coupled to a metal tread pan, with various components of the assembly cut away at different lengths for illustrative purposes.

The cover 18 can be comprised of a flexible, durable material, such as PVC or other polymeric material. The cover 18 can comprise an elongated sheet of material having curled or hooked front 62 and rear 60 portions that engage with the front edge 32 and rear edge 30, respectively, of the base 12 to hold the cover 18 in place over the base 12 and plate 14, as shown in FIGS. 3 and 5.

As shown in FIGS. 1 and 5, the cover 18 can comprise a horizontal nick, or weakened region, 64 adjacent to the rear portion 60 that extends lengthwise of the cover 18 and allows the cover to easily fracture along the nick 64 to facilitate removal of the exposed portion of the cover 18 from the nosing assembly 10. The nick 64 can comprise one or more slots, grooves, perforations, apertures, weakened regions, and/or other structural features that facilitate the separation of the rear portion 60 from the remainder of the cover when the cover is lifted upwardly from the stair. The structural features that comprise the nick 64 can be located at one or both of the inner and outer, or forward-facing and rear-facing, surfaces of the cover between the rear portion 60 and the remainder of the cover. The nick 64 can furthermore be pre-stressed or pre-weakened prior to assembly with the base 12 to further facilitate fracturing.

The nosing assembly 10 can be installed on different types of stair frames. As a first example, the nosing assembly 10 can be installed on a stair frame as shown in FIGS. 3 and 4. This exemplary stair system can comprise a generally vertical metal plate 100 and a generally horizontal metal plate 102. The front plate 100 can have a rearwardly extending, horizontally disposed upper lip 104 that engages with the lip 40 of the base 12. The lip 104 can extend into a gap formed between the upper surface of the lip 40 and the lower surface of the upper portion 20. The lip 40 can resiliently flex to expand the gap and receive the metal lip 104 in the gap. The upper surface of the lip 104 can contact the upper portion 20 while the front lip 24 of the base 12 can contact the front surface of the plate 100 to hold the nosing assembly 10 on the metal stair frame. The anchor portion 36 and rear flange 34 of the base can hang freely behind the lip 104. Concrete can then be poured into the pan formed by the plates 100, 102. The concrete can fill the pan up to the level of the top surface of the cover 18, or slightly lower, such as up to the level of the upper surface of the plate 16. The rear portion 60 of the cover can be submerged in the concrete and pinned between the rear edge 30 of the base 12 and the concrete. The anchor portion 36 and the rear flange 34 of the base can also be submerged in the concrete. The expanded lower end portions 38 and 44 and the cavity 35 assist in physically retaining the base 12 in the concrete.

After the concrete cures (see FIG. 4) and/or after construction of the stair case is complete, the cover 18 can be removed. The front portion 62 of the cover can be pulled forwardly away from the lower edge 32 of the front lip 24 of the base 12 to free the front of the cover 18 from the stair. The front portion 62 can then be lifted upwardly until the rear portion 60 of the cover 18 fractures apart from the rest of the cover at the nick 64. As the majority of the cover 18 is separated from the stair, the rear portion 60 of the cover can remain buried in the concrete beneath and behind the rear edge 30 of the base 12. The nick 64 can be positioned in the cover 18 such that the rear portion 60 of the cover that remains in the concrete can have an upper surface that is flush with the level of the concrete and/or the rear edge 30 of the base 12.

In other embodiments, such as shown in FIG. 5, the nosing assembly 10 can be installed with a stair system that lacks a vertical plate and rearwardly projecting metal lip for the nosing assembly for attachment. In one such stair system, a temporary mold, or framework can be constructed and concrete can be poured into the mold to form the stair tread. As the concrete cures, the nosing assembly 10 can be pressed into the concrete such that the front lip 24 rests against the front of the concrete stair and the upper surface of the cover 18 is flush with or slightly above the level of the concrete. The anchor portion 36 and the rear flange 34 of the base 12 can be submerged in the concrete such that the expanded portions 44, 38 fix the base 12 in the concrete. After curing, the framework can be removed, leaving the nosing assembly 10 at the upper front edge of the concrete tread. After construction, the cover 18 can be removed, as described above, exposing the front and upper portions of the base 12 and the plate 14.

In some embodiments of the nosing assembly 10, the anchor portion 36 of the base 12 can comprise a hooked lip portion 40 without a downwardly projecting flange 42, as shown in FIGS. 3 and 5, for examples. The downwardly projecting flange 42 may not be needed to secure the base 12 to the concrete, such as when the lip portion 40 is clipped onto a rearwardly extending lip 104 of the stair frame, as in FIG. 3.

In an alternative embodiment, an additional component can be included in the nosing assembly 10, as shown in FIG. 5, that engages the lip portion 40 and provides a downwardly projecting flange for embedding in the concrete. For example, an adapter, or anchor, 80 (see FIG. 5) can be provided that comprises an upper lip 82 that engages with the lip 40 of the base 12. The adapter 80 can further comprise a downwardly extending flange portion 84 terminating in an expanded lower edge 86 that serves the same purpose as the lower edge 44 shown in FIG. 1. The adapter 80 can have a cross-sectional shape generally in the form of a question mark, as shown in FIG. 5. The adapter 80 can comprise a single elongated strip or it can comprise a plurality of separate pieces that can be spaced apart along the length of the base 12. The adapter 80 can be used, for example, to convert a base 12 that was designed to be used with a stair frame having metal lip 104 that engages the lip 40, as in FIG. 3, to be used with a stair frame that does not have such a lip.

In other embodiments, an additional component can be added to the rear of the base 12, such as adapter 90 shown in FIG. 5. The adapter 90 can have an upper rib 92 that engages, such as with a snap or friction fit, within the cavity 35 at the rear of the base 12. The adapter 90 can extend below the level of the rear flange 34 and can comprise an expanded lower edge 94. The adapter 90 can, in effect, extend the height of the rear flange 34 as desired. In some embodiments, (not shown) the lower edge 94 can contact a lower surface of the concrete stair, such as the bottom of a metal tread pan, to create a rear support for the nosing. This feature can help keep the upper surface of the nosing level and at a desired height relative to the concrete. The adapter 90 can comprise a single elongated strip or can comprise a plurality of separate pieces that can be spaced apart along the length of the base 12. In some embodiments, both adapters 80 and 90 can be used.

One benefit of the nosing assemblies 10 described herein is that the cover 18 can protect the exposed surfaces of the base 12 and plate 14 during the installation of the stair and for an additional period of time after installation is complete, until the cover is removed. For example, after the installation of the nosing on a stair, the stair may be used by construction workers while the remainder of the building is constructed and finished. This period of time after the stairs are constructed and before the building is finished can expose the base 12 and plate 14 to significant damage, wear, contamination, etc. For example, the upper features of the plate can be scratched, dented or splashed with paint or other material while the building is being finished. The cover 18 can prevent and/or reduce these undesirable and unnecessary exposures. When the building is complete and ready for normal use, the covers 18 can be removed leaving a pristine nosing. The removable cover 18 described herein can obviate the alternative use of duct tape covering or other ad hoc protective devices used by construction workers to cover the stair nosing. These ad hoc attempts to protect the nosing can furthermore be less effective, less accurate, more time consuming and/or more expensive that using the nosing assemblies described herein. The cover 18 can be very tough and durable, can precisely cover the areas of the nosing that need to be protected, can come pre-installed with the rest of the nosing, and can be removed in one quick motion without leaving any residue or markings behind. The cover 18 can furthermore comprise upper surface features that provide functional benefits, such as traction and illumination, to the construction workers prior to removal.

The nosing assembly 10 can be pre-assembled with the base 12, plate 14 and cover 18 engaged together. The adapter 80 and/or the adapter 90 can also be pre-engaged with the bottom of the base 12. Thus, the installer merely needs to remove the nosing assembly 10 from its packaging and either clip it onto a flange of a stair frame, as shown in FIG. 3, or press the nosing assembly into wet concrete. After the concrete cures, the installer simply lifts and breaks the cover off and the stair nosing is ready for use. Later, if desirable, the plate 14 can be peeled off and replaced with another plate without removing or damaging any other portion of the nosing other than the adhesive 16.

In some embodiments, the base 12 and/or the cover 18 can be made of a material that is photoluminescent and/or emits light in the dark. Portions of the base 12 can be exposed below and behind the plate 14, such that the nosing can be easily recognized by a person moving up or down the stairs.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically (e.g., mechanically, chemically, magnetically, etc.) coupled or linked and does not exclude the presence of intermediate elements between the coupled or associated items absent specific contrary language.

In view of the many possible embodiments to which the principles of the disclosed invention may be applied, it should be recognized that the illustrated embodiments are only preferred examples and should not be taken as limiting the scope of the disclosure. Rather, the scope of the disclosure is defined by the following claims. I therefore claim all that comes within the scope of these claims.

I claim:

1. A stair nosing assembly comprising:

an elongated base comprising:

a generally horizontal tread portion having a first side and a second side that define an elongated side-to-side length, the tread portion further comprising a rear edge and a front end defining a front-rear direction that is perpendicular to the side-to-side length;

a front portion extending downwardly from the front end of the tread portion and comprising a bottom edge; and at least one anchor portion extending downwardly from the tread portion and adapted to be embedded in a concrete tread of a stair; and an elongated cover mounted on the base and comprising:

an anchor portion adapted to be at least partially embedded in a concrete tread; and a cover portion adapted to temporarily cover the tread portion and the front portion of the base when the anchor portion of the base is embedded in a concrete tread, wherein the cover has a length substantially equal to the side-to-side length of the treat portion;

wherein the cover has an elongated weakened region extending along substantially the entire length of the cover between the anchor portion of the cover and the cover portion of the cover, such that the cover is configured to fracture along the elongated weakened region when the cover portion of the cover is lifted from the base while the anchor portion of the cover and the base are embedded in a concrete tread.

2. The assembly of claim 1, wherein the cover portion of the cover comprises a generally horizontal upper portion having a rear edge, a front portion extending downwardly from a front of the upper portion, and a front lip extending rearwardly from a lower end of the front portion of the cover and configured to engage with the bottom edge of the front portion of the base, and the anchor portion of the cover comprises a rear lip extending from the rear edge of the upper portion of the cover and configured to engage with the rear edge of the tread portion of the base, such that the cover covers the upper and front surfaces of the base and is retained on the base via the engagement of the front lip and the rear lip with the base.

3. The assembly of claim 1, further comprising an elongated plate adhesively secured to an upper surface of the base and positioned between the base and the cover.

4. The assembly of claim 2, wherein the rear lip of the cover is configured to be embedded in the concrete when the assembly is secured to a concrete stair tread.

5. The assembly of claim 2, wherein the cover is configured to fracture into a first piece and a second piece, the first piece comprising the front lip, the front portion, and the upper portion, the second piece comprising the rear lip.

6. The assembly of claim 5, wherein the second piece of the cover is configured to remain in the concrete with the base after the first piece of the cover is removed.

7. The assembly of claim 2, wherein the rear lip comprises a first portion extending downwardly from the rear edge of the upper portion of the cover, and a second portion extending forwardly from a lower edge of the first portion.

8. The assembly of claim 7, wherein the second portion of the rear lip is positioned underneath the rear edge of the tread portion of the base.

9. The assembly of claim 7, wherein the weakened region is between the rear edge of the upper portion of the cover and the second portion of the rear lip.

10. The assembly of claim 1, wherein the weakened region comprises one or more regions along the length of the cover having reduced thickness.

11. The assembly of claim 1, wherein the weakened region comprises one or more perforations along the length of the cover.

12. The assembly of claim 1, wherein the anchor portion of the base comprises a forwardly projecting lip forming a channel between a lip and the tread portion of the base, wherein the assembly is configured to be attached to a rearwardly extending lip of a tread pan of the stair by inserting the lip of the tread pan into the channel of the base.

13. The assembly of claim 12, wherein the anchor portion of the base further comprises an expanded lower edge projecting below the lip of the base and configured to become embedded in the concrete tread of the stair.

14. A stair nosing assembly comprising:

an elongated base comprising a generally horizontal tread portion having a rear edge, a generally vertical front portion extending downwardly from a front of the tread portion and comprising a bottom edge, and at least one anchor portion extending downwardly from a lower surface of the tread portion and configured to be embedded in a concrete stair tread;

an elongated metal plate secured to an upper surface of the base, the plate comprising a plurality of horizontally extending ridges;

an elongated polymeric cover comprising a generally horizontal upper portion having a rear edge, a front portion extending downwardly from a front of the upper portion, a front lip extending from a lower end of the front portion of the cover and configured to engage with the bottom edge of the front portion of the base, and a rear lip extending from the rear edge of the upper portion of the cover and configured to engage with the rear edge of the tread portion of the base, such that the cover covers the entire upper and front surfaces of the base and is retained on the base via the front lip and the rear lip;

wherein the rear lip of the cover comprises a first portion extending downwardly from the rear edge of the upper portion of the cover, and a second portion extending forwardly from a lower edge of the first portion and positioned below the rear edge of the tread portion of the base;

wherein the first portion of the rear lip of the cover comprises a weakened region extending along a length of the cover, such that the cover is configured to fracture at the weakened region into first and second pieces when the nosing assembly is embedded in a concrete stair tread and the front portion of the cover is lifted upward from the base, the first piece comprising the second portion of the rear lip of the cover and remaining embedded in the concrete stair tread, and the second piece comprising the front and upper portions of the cover and configured to detach from the base and the plate when the weakened region is fractured.

* * * * *